US005328796A

United States Patent [19]

Shimomura et al.

[11] Patent Number: 5,328,796

[45] Date of Patent: Jul. 12, 1994

[54] DIAZO TYPE RECORDING MATERIAL UTILIZING MICROENCAPSULATED DIAZO COMPOUND, A COUPLER AND A HYDROXYPHENYLSULFONE DERIVATIVE

[75] Inventors: Akihiro Shimomura; Taketatsu Sugiyama; Makoto Ohno; Toshiharu Tanaka, all of Shizuoka, Japan

[73] Assignee: Fuji Photo Film Co., Ltd., Kanagawa, Japan

[21] Appl. No.: 53,381

[22] Filed: Apr. 28, 1993

[30] Foreign Application Priority Data

Apr. 28, 1992 [JP] Japan ..... 4-135787

[51] Int. Cl.[5] ..... G03C 1/58; G03C 1/91

[52] U.S. Cl. ..... 430/138; 430/151; 430/157; 430/171; 430/177; 430/180; 430/181

[58] Field of Search ..... 430/138, 171, 177, 180, 430/181, 157, 151

[56] References Cited

U.S. PATENT DOCUMENTS 4,599,271 7/1986 Chao ..... 430/138

4,980,260 12/1990 Shinozaki et al. ..... 430/171

5,236,800 8/1993 Nakamura et al. ..... 430/181

FOREIGN PATENT DOCUMENTS 59-91438 5/1984 Japan .

OTHER PUBLICATIONS

The English language abstract for JP-A-59-91438.

*Primary Examiner*—Charles L. Bowers, Jr.
*Assistant Examiner*—Christopher G. Young
*Attorney, Agent, or Firm*—Sughrue, Mion, Zinn, Macpeak & Seas

[57] ABSTRACT

A diazo type recording material, which has a substantially unstained background, a superior preservability, and is capable of producing images of high density, wherein the diazo recording material comprises a support having thereon a recording layer comprising a photosensitive diazo compound, a hydroxyphenylsulfone derivative and a coupling component which forms a color by reacting with the diazo compound, with the diazo compound being enclosed in microcapsules.

13 Claims, No Drawings

DIAZO TYPE RECORDING MATERIAL UTILIZING MICROENCAPSULATED DIAZO COMPOUND, A COUPLER AND A HYDROXYPHENYLSULFONE DERIVATIVE

FIELD OF THE INVENTION

The present invention relates to a recording material which contains a photosensitive diazo compound, particularly a diazo type recording material, the background of which has improved stability against staining during storage.

BACKGROUND OF THE INVENTION

Copy producing materials which exploit the photosensitivity of diazo compounds are widely utilized because of their inexpensiveness. These copy producing materials are generally developed according to one of three major types of development, which are as follows:

The first type is known as the wet development type, where the copy producing material is characterized by a photosensitive layer mainly comprising a diazo compound and a coupling component on a support, and it is developed by an alkaline solution after exposure to light together with an original manuscript superposed on the top thereof.

The second type is known as the dry development type, where the exposed photosensitive layer is developed by ammonia gas instead of an alkaline solution per the wet development type.

The third type is known as the thermal development type, where the photosensitive layer contains an ammonia gas generating agent, such as urea, that generates ammonia gas upon heating, or, alternatively, it contains an alkaline salt compound, such as trichloroacetic acid, that loses its acidic properties upon heating or it exploits activation of a diazo compound and a coupling component through thermal fusion by adding a higher fatty acid amide as a color-forming aid.

The above wet type of development has various drawbacks. For example, the use of the alkaline developing solution takes time for refilling and disposing thereof, and the large size of the copying devices creates difficulties in maintenance and control. Further, entering additional exposures and images on the wet recording material is practically impossible immediately after copy-making when the material is still wet, and the copied images cannot endure long storage.

The dry type of development has several drawbacks as well. For instance, refilling of the developing solution is necessary, and an ammonia gas suction device should be provided to prevent leakage of the generated gas, which enlarges the size of the copying device, and a strong odor of the noxious ammonia is unavoidable immediately after copy-producing.

Apart from the wet type or the dry type of development, the thermal developing type has merit in terms of lessened maintenance as it does not require the use of a developing solution. However, it still has a shortcoming in that the copy forming apparatus becomes expensive in order to obtain satisfactory images, as the development temperature is as high as 150° to 200° C. and thermal controls must be made within the range of ±10° C. to prevent variations in color tone due to inadequate development.

To stand such high temperatures required in thermal development, the diazo compounds to be used must be heat-resisting, but these compounds are disadvantageous to form images of high density.

Therefore, many attempts in the past have been attempted to make developments at low temperature (e.g., 90° to 130° C.), but it had a defect of shortening the shelf life of the copy material. The current situation is that the thermal development type of development is not yet occupying a position as the main stream in the diazo copying system, in spite of the prediction that the thermal development type has advantages in terms of lessened maintenance in comparison to the wet and dry types of development.

On the other hand, the needs of users may be completely diverse. For example, needs are arising not only to obtain colored images on a white background, as was the case in the past, but also to select the background and a hue of the image in correspondence with the use desired.

This need arises because copy images should draw the viewer's attention when such images are used as drawings or notices. However, the existing recording materials could not fully satisfy such visual requirements.

Incidentally, in order to obtain the desired color density by heating a recording material provided with a layer containing a diazo compound, a coupling component and a color-forming aid, then the respective constituents, as mentioned above, should be able to melt, disperse and react to form the coloring matter in an instantaneous manner.

However, if the recording material was designed so as to well form the color and produce images of high density at the low heating temperatures, then the color-forming reaction would tend to gradually proceed inadvertently during storage at normal room temperature before usage, and, as a consequence, the background of the recording material to be non-exposed and kept white would be colored and thus spoiled. That is, background stains occur in the recording layer before recording.

The above-described problem was somewhat overcome by a proposal for enclosing a diazo compound in microcapsules in the copy-making material provided with a photosensitive layer, which contains all of the diazo compound, a coupling constituent and a color-forming aid, on the support, and which can be thermally developed (e.g., JP-A-59-91438). The term "JP-A" as used herein means an "unexamined published Japanese patent application".

However, this case still had a drawback that preservability of the recording material before use is insufficient when the photosensitive layer is designed to obtain images of very high density.

SUMMARY OF THE INVENTION

As a result of intense studies to solve the above-mentioned problems, the inventors of the present invention have achieved very satisfactory results by including a hydroxyphenylsulfone derivative in the photosensitive or recording layer. Therefore, the object of this invention is to provide a diazo type recording material of which the background is not easily smudged or stained and is more preservable than the prior art materials.

The above-described object of the present invention has been achieved by provision of a diazo type recording material which is provided with a recording layer containing a photosensitive diazo compound, a hydroxyphenylsulfone derivative and a coupling compound which forms a color by reacting with the above-mentioned diazo compound and is further characterized in having said diazo compound enclosed in microcapsules.

DETAILED DESCRIPTION OF THE INVENTION

The diazo compound which can be used in this invention may be appropriately selected from among known diazo compounds, such as photolytical diazonium salts, diazosulfonates and diazoamino compounds which form the color by reacting with a coupling component and decomposes by exposure to light.

Among these diazo compounds, in view of considerations of both photosensitivity and image density, diazonium salts represented by general formula $AN_2^+X^-$ are most preferable (wherein A refers to a substituted or unsubstituted diazonium aromatic group, $N_2^+$ to a diazonium group and $X^-$ to an anion of acid).

Specific examples of the diazonium salts include 4-diazo-1-dimethylaminobenzene, 4-diazo-1-diethylaminobenzene, 4-diazo-l-dipropylaminobenzene, 4-diazo-1-methylbenzylaminobenzene, 4-diazo-1-dibenzylaminobenzene 4-diazo-1-ethylhydroxyethylaminobenzene, 4-diazo-1-diethylamino-3-methoxybenzene, 4-diazo-1-dimethylamino 2-methylbenzene, 4-diazo-1-benzoylamino-2,5-diethoxybenzene, 4-diazo-1-morpholinobenzene, 4-diazo-1-morphol-ino-2,5-diethoxybenzene, 4-diazo-1-morpholino-2,5-dibu 4-diazo-1-tolylmercapto-2,5-diethoxybenzene and 4-diazo-1, 4-methoxybenzoylamino-2,5-diethoxybenzene.

Specific examples of the acids which can be used for forming the diazonium salts described above include $C_nF_{2m+1}SO_3H$, wherein n represents an integer of 1 to 9, $C_mF_{2m+1}SO_3H$, wherein m represents an integer of 1 to 9, boron tetrafluoride, tetraphenylboron, hexafluorophosphoric acid, aromatic carboxylic acid and metallic halides such as zinc chloride and stannic chloride.

Coupling compounds which can be used in the present invention are compounds which undergo coupling reactions with diazo compounds in a basic pH environment to form a color. Specific examples of such coupling compounds include resorcin, fluoroglycine, sodium 2,3-dihydroxynaphthalene-6-sulfonate, 1-hydroxy-2-naphthoic morpholinopropylamide, 1,5-dihydroxynaphthalene, 2,3-dihydroxynaphthalene, 2,3-dihyroxy-6-sulfanilnaphthalene, 2-hydroxy-3-naphthoic morpholinopropylamide, 2-hydroxy-3-naphthoic anilide, 2-hydroxy-3-naphthoic-2'-methyl-anilide, 2-hydroxy-3-naphthoic ethanolamide, 2-hydroxy-3-naphthoic octylamide, 2-hydroxy-3-naphthoic-N-dodecyloxy-propylamide, 2-hydroxy-3-naphthoic tetradecylamide, acetanilide, acetoacetanilide, benzoylacetanilide, 1-phenyl-3-methyl-5-pyrazolone, 1-(2', 4', 6'-trichlorophenyl)-3-benzamido-5-pyrazolone, 1-(1', 4', 6'-trichloro-phenyl)-3-anilino-5-pyrazozolone and 1-phenyl-3-phenyl-acetamido-5-pyarazolone.

From a practical standpoint, it can be understood that images of any desired color tone can be obtained by the combined use of two or more coupling compounds.

In the present invention, the addition of a basic (pH) substance to the system as a color-forming aid is desirous, if needed in thermal development, for facilitating the coupling reaction by making the system alkaline. As such basic additives, scarcely soluble or insoluble basic substances or substances which will generate alkali upon heating may be used.

Specific examples of the color-forming aid basic substances include nitrogen-containing compounds such as inorganic or organic ammonium salts, organic amines and amides, ureas, thioureas and derivatives thereof, thiazoles, pyrroles, pyrimidines, piperazines, guanidines, indoles, imidazolines, triazoles, morpholines, piperidines, amidines, formamidines and pyridines. Two or more of these basic substances can be used in combination.

In the present invention, additional compounds such as phenol derivatives, naphthol derivatives, alkoxy-substituted benzenes, alkoxy-substituted naphthalenes, hydroxy compounds, acid compounds or sulfonamide compounds can be incorporated in a photosensitive layer to ensure rapid and perfected heat development by less energy. These compounds will serve to lower the melting point of the coupling compound and the basic substances, or to promote heat transmission of the microcapsule wall, thus acting as a color-forming aid and leading to higher color density.

Thermo-fusing substances are typically included in the color-forming aids used in the present invention. The term, thermo-fusing substance, as used herein means substances which are solids at the normal room temperature, fused by heating, having the melting point within the range of 50° to 150° C., and can fuse diazo compounds, coupling compounds and basic substances.

Specific examples of the thermo-fusing substances as described above are fatty amides, N-substituted fatty amides, ketone compounds, urea compounds and esters.

Hydroxyphenylsulfone derivatives which are used in the present invention are compounds represented by formula (1) as shown below. Compounds as represented by formula (2) are especially preferable.

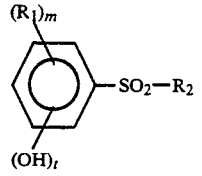

(1)

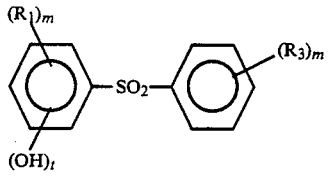

(2)

In formula (1), $R_1$ stands for a hydrogen atom, a substituted or unsubstituted alkyl group, preferably a straight or branched lower alkyl group having (1 to 8 carbon atoms (e.g., methyl ethyl, n-propyl or isopropyl), substituted or unsubstituted alkoxy group having preferably 1 to 8 carbon atoms (e.g., methoxy, ethoxy, n-propyloxy or iso-propyloxy) or substituted or unsubstituted amino group, or a halogen atom; $R_2$ stands for a substituted or unsubstituted alkyl group having preferably 1 to 8 carbon atoms (e.g., methyl, ethyl, n-propyl or iso-propyl) or a substituted or unsubstituted aryl group having preferably 6 to 15 carbon atoms (e.g., phenyl or naphthyl) and may have the same substituents for the alkyl, alkoxy and amino groups represented by $R_1$, t stands for 1 or 2 and m stands for an integer of 0 to 3.

In formula (2), $R_1$, t and m are as defined for formula (1), and $R_3$ stands for a hydrogen atom, a substituted or unsubstituted alkyl group, preferably a straight or branched lower alkyl group having 1 to 8 carbon atoms (e.g., methyl, ethyl, n-propyl or iso-propyl), substituted or unsubstituted alkoxy group having preferably 1 to 8 carbon atoms(e.g., methoxy, ethoxy, n-propyloxy or iso-propyloxy) or substituted or unsubstituted amino group, or a halogen atom.

Specific non-limiting examples of hydroxyphenylsulfone derivatives include compounds as represented by the following formulae (3) through (21).

(3)

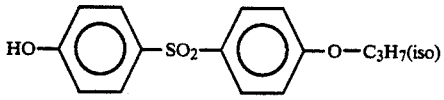

(4)

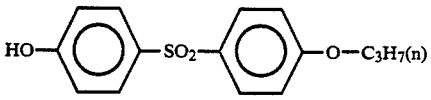

(5)

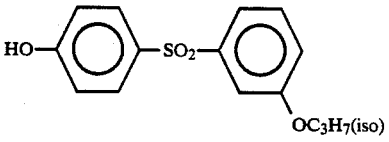

(6)

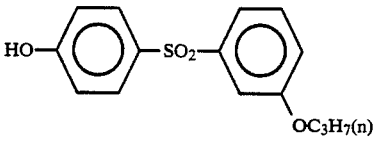

(7)

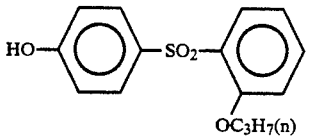

(8)

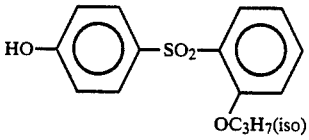

(9)

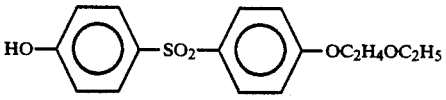

(10)

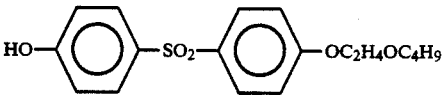

(11)

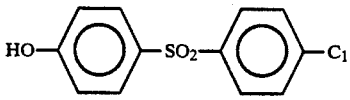

(12)

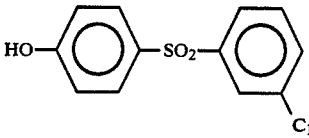

-continued (13)

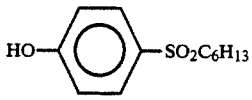

(14)

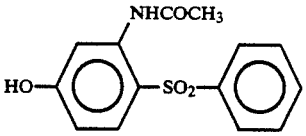

(15)

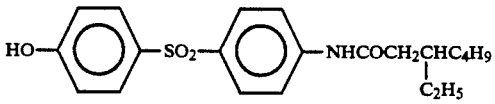

(16)

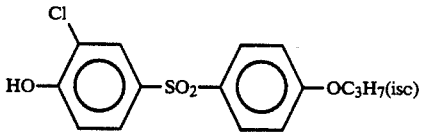

(17)

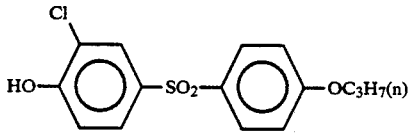

(18)

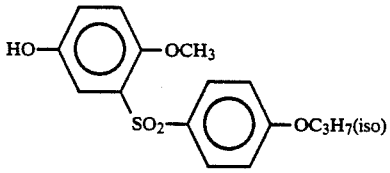

(19)

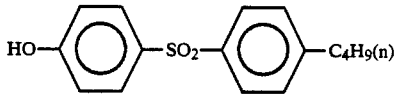

(20)

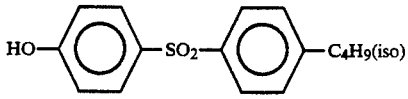

(21)

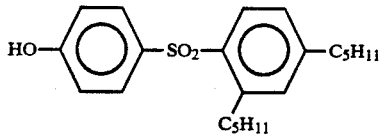

The occurrence of background stains before recording in the recording layer can be prevented by including at least one of the hydroxyphenylsulfone derivatives in the recording layer. The quantity of the hydroxyphenylsulfone derivative compound to be added to the recording layer is preferably 0.05 to 2 g/m$^2$ as a dry coated amount. A quantity less than 0.05 g/m$^2$ may not be effective for preventing recording layer stain, while a quantity more than 2 g/m$^2$ may undesirably lower the thermo-sensitivity of the recoding.

The hydroxyphenylsulfone compound can be located either inside the microcapsules, outside the microcapsules or in the microcapsule wall. It may be located in one or more of the above locations, but inclusion in the microcapsules is preferred.

In the present invention, reducible metallic salts may be added to the recording layer in order to improve storage stability of the recording material. Details of such metallic salts are described in Japanese Patent Application No. 3-313467. Also in the present invention, the ratio of a coupling compound to one part (by weight hereinafter unless otherwise indicated) of diazo compound is preferably 0.1 to 10 parts, and that of a color-forming aid to one part of diazo compound is preferably 0.1 to 20 parts.

Desired coating quantity of diazo compound is preferably 0.05 to 5.0 g/m$^2$.

Microcapsules for the present invention are produced by known methods of forming walls of high molecular substances around oil drops, after emulsifying core substances. A reactant which forms high molecular substances is added to inside and/or outside the oil drops. Specific examples of the high molecular substances include polyurethane, polyurea, polyamide, polyester, polycarbonate, ureaformaldehyde resin and melamine resin.

Two or more kinds of such high molecular substances can be used together. Preferred high molecular substances include polyurethane, polyurea, polyamide, polyester and polycarbonate. Preferred high molecular substances are those which do not fuse at the temperature encountered in thermo-recording and have the melting point higher than 150° C.

Microcapsules can be made of an emulsified liquid containing more than 2% of components of the present invention to be microencapsuled.

Microcapsules used in the present invention are preferably those which substantially contain no solvent and are obtained by removing the solvent while in polymerizing reaction after a diazo compound and a coupling compound are dissolved in a non-aqueous solvent having a low boiling point together with a monomer for forming the capsule wall.

Polymers to form the microcapsule wall can be prepared by polymerizing an appropriate monomer in accordance with the process, as described above. The quantity of monomer to be used will be determined as a function of the-average particle size of the microcapsules to be obtained of approximately 0.3 to 12 μm and a wall thickness of approximately 0.01 to 0.3 μm.

By enclosing a diazo compound, but not the coupling component, in microcapsules produced as mentioned above, contacts between the diazo compound with a coupling compound at normal temperature can be prevented more effectively than before.

A coupling compound, a basic substance and other color-forming aids, which are not enclosed in microcapsules are used more desirably in solid form as dispersed by a sand mill together with water-soluble high polymers to form a matrix into which the microcapsules are dispersed. Preferable water-soluble high polymers are those used for preparing microcapsules (such as those quoted in JP-A-59-190886). In this case, a coupling component and color-forming aids must be added to an aqueous solution of water-soluble high polymers to obtain 5 to 40% solutions. The preferable size of dispersed particle is smaller than 10 μm.

The coating liquid of the recording layer of the present invention can be applied to a support in methods, such as described in the book written by Yuuji Harasaki, entitled "Coating Engineering" (253 pages, 1973, Asakura Bookstore), in addition to widely known methods such as bar coating, blade coating, air knife coating, gravure coating, doctor coating, slide coating, roll coating, spray coating, dip coating or curtain coating.

The support material can be selected from a paper or thermoplastic film known in the field.

The recording or photosensitive layer under the present invention can be provided in a coating amount of from 2.5 to 30 g/m$^2$ in solid weight after coated and dried on a support.

In the recording material of the present invention, a diazo compound, a coupling compound and basic substances can be included in the same layer as described above. Alternatively, these components can be included in a lamination comprising a separate layer for each respective constituent, or combinations thereof, with no particular constraint on the sequence of these layers. It is also possible to provide a photosensitive layer on an intermediate layer laid on the support, as described in Japanese Patent Application No. 59-177669. Also, another protective layer may be provided on the upper surface of the photosensitive layer.

To form an image on the recording material of the present invention, the diazo compound in the photosensitive layer is decomposed imagewise by light exposure corresponding to a manuscript, initially, and the colored image is obtained by reactions of the diazo compound and the coupler through heating of the entire surface of the recording material, or, alternatively, thermal recording is made imagewise on the surface of recording material by the contact of a thermal pen or thermal head and then the diazo compound in the uncolored portion is decomposed and fixed by exposure of the entire surface by light.

Though contact exposure corresponding to the manuscript imagewise is facile, if the manuscript is written on a transparent material, exposure by other methods or, for example, by the laser light can be applied as well.

Various fluorescent lamps, xenon lamps or mercury lamps are useful as the light source for exposure. In this case, it can be understood that is desirable that the emission spectrum of the light source matches the absorptive spectrum of the diazo compound used in the recording layer.

As the heating media used during the process to develop the entire surface of photosensitive layer of the recording material by heating, infrared light, high-frequency wave, heat blocks or heat rollers can be applied.

As described above, a diazo type recording material containing hydroxyphenylsulfone derivatives improves prevention of stains in background of the recording layer before use, though the reasons therefor are not completely understood at this time.

The following examples serve to illustrate details of the present invention but should not be construed as being limited thereto.

All parts referred to hereinafter are by weight.

EXAMPLE 1

Preparation of Microcapsule Solution

Two parts diazonium salts represented by formula (22) below and 1 part of the hydroxyphenylsulfone compound represented by the foregoing formula (3) were added to 13 parts of ethyl acetate to make a solution.

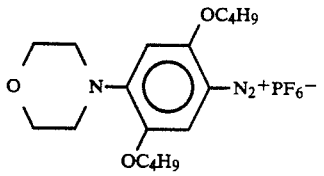

(22)

5 parts of isocyanate represented by Formula 23 described below was added to the solution obtained as described above and mixed by stirring.

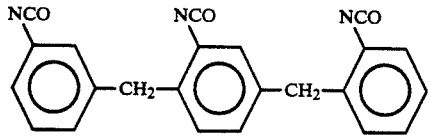

(23)

An emulsion with the average particle size of 1.0 μm was prepared by adding and emulsifying the thus obtained diazonium salt, isocyanate and ethyl acetate solution of the compound represented by formula (3) in an aqueous solution of polyvinyl alcohol (PVA217E manufactured by Kuraray Co.) in a ratio of 3.5 parts to 60 parts of water. Then, 20 parts of water was added to the obtained emulsion, and isocyanate, as a wall forming substance, was reacted with the emulsion for 3 hours by stirring and heating up to 40° C., thus finally obtaining microcapsules containing the diazo compound and the compound represented by formula (3) as a core substance having an average particle size of 1 μm.

The above-described encapsulating reaction was conducted under the reduced atmosphere of 400 to 500 mmHg by an water circulating pump.

Preparation of Coupler-Dispersed Solution

By adding 5 parts of 2-dihydroxy-3-naphthonic anilide, 5 parts of triphenylguanidine and 10 parts of the compound represented by formula (24) to 100 parts of 5% aqueous solution of polyvinyl alcohol and dispersing the solution by a sand mill for 24 hours, a coupler-dispersed solution with an average particle size of 2 μm was obtained.

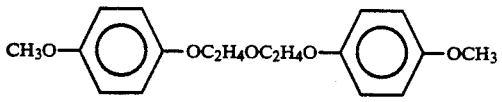

(24)

Preparation of Coating Liquid

A coating liquid was prepared by adding 25 parts of the above-described coupler-dispersed solution to 2 parts of 40% calcium carbonate (Univer 70 manufactured by Shiraishi Industries) and with 0.5 parts of water to 8 parts of the above microcapsule solution containing the diazonium salt and hydroxyphenylsulfone.

Preparation of Recording Material

The recording material was prepared by coating the fine surface of a woodfree paper (76 g/2m$^2$) with the above-described coating liquid so as to form a dried weight of 5 g/m$^2$ by using a coating bar and drying it for three minutes at 50° C.

Assessment on Preservability

In order to make assessment on preservability of the recording material before use, a forced deterioration test was carried out for 6 hours in a dark atmosphere with the relative humidity of 90% at 40° C. The background density determined before and after the above forced deterioration using a Mcbeth densitometer indicated 0.12 and 0.14, respectively, and there was thus no deterioration recognized.

COMPARISON EXAMPLE 1

The recording material was prepared in the same manner as in Example 1 except the compound represented by formula 3 was not used in this comparison. The resulting recording material was subjected to the deterioration test in the same manner as in Example 1. The background density was 0.13 before the testing and the background density after the testing was 0.26.

COMPARISON EXAMPLE 2

The recording material was prepared in the same manner as done in Example 2 except the compound represented by formula (3) was substituted by the compound represented by formula (25) shown below. As a result of the deterioration test conducted in the same manner as in Example 1, the background density was 0.13 before the testing, while the same after the testing was 0.27.

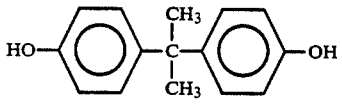

(25)

The results obtained by the example and comparison examples show the unexpected effectiveness of the present invention.

While the invention has been described in detail and with reference to specific embodiments thereof, it will be apparent to one skilled in the art that various changes and modifications can be made therein without departing from the spirit and scope thereof.

What is claimed is:

1. A recording material, comprising a support and a recording layer located on said support, said recording layer comprising a photosensitive diazo compound, a hydroxyphenylsulfone deriative and a coupling compound, wherein said photosensitive diazo compound, said hydroxyphenylsulfone derivative and said coupling compound are each present in an amount whereby said coupling compound forms a color upon reaction with said diazo compound and occurrence of background stains in said recording material is substantially prevented, and wherein said diazo compound is encapsulated in microcapsules.

2. The recording material of claim 1, wherein said hydroxyphenylsuflone derivative is represented by formula (1):

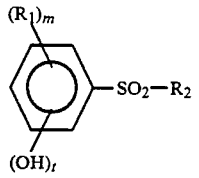

(1)

wherein $R_1$ represents a hydrogen atom, a substituted or unsubstituted alkyl group, a substituted or unsubstituted alkoxy group, a substituted or unsubstituted amino group or a hologen atom; $R_2$ represents a substituted or unsubstituted alkyl group or a substituted or unsubstituted aryl group, t represents 1 or 2; and m represents an integer of 0 to 3.

3. The recording material of claim 1, wherein said hydroxphenylsulfone derivative is represented by formula (2):

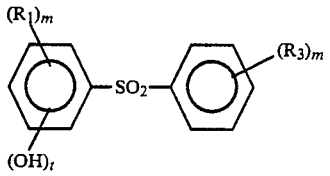

(2)

wherein $R_1$ represents a hydrogen atom, a substituted or unsubstituted alkyl group, a substituted or unsubstituted alkoxy group, a substituted or unsubstituted amino group or a halogen atom; t represents 1 or 2; and m represents an integer of 0 to 3; and $R_3$ represents a hydrogen atom, a substituted or unsubstituted alkyl group, a substituted or unsubstituted alkoxy group, a substituted or unsubstituted amino group or a halogen atom.

4. The recording material of claim 1, wherein said hydroxyphenylsuflone derivative is present in said recording layer in a dry coated amount of 0.05 to 2 g/m$^2$.

5. The recording material of claim 1, wherein said photosensitive diazo compound is selected from the group consisting of a photolytical diazonium salt, a diazolsulfonate and a diazoamino compound.

6. The recording material of claim 1, wherein said photosensitive diazo compound is a diazonium salt represented by $AN^+X^-$, wherein A represents a substituted or unsubstituted diazonium aromatic group, $N_2^+$ represents a diazonium group and $X^-$ represents an acid anion.

7. The recording material of claim 1, wherein said coupling compound is selected from the group consisting of resorcin, fluoroglycine, sodium 2,3-di- hydroxynaphthalene-6-sulfonate, 1-hydroxy-2-naphtoic morpholinopropylamide, 1,5-dihydroxynaphthalene, 2,3-dihydroxynaphthalene, 2,3-dihydroxy-6-sulfanilnaphthalene, 2-hydroxy3-naphthoic morpholinopropylamide, 2-hydroxy-3naphthoic anilide, 2-hydroxy-3-naphthoic-2'-methyl-anilide, 2-hydroxy-3-naphthoic ethanolamide, 2-hydroxy-3-naphthoic octylamide, 2-hydroxy-3-naphthoic tetradecylamide, acetanilide, acetoacetanilide, benzoylacetanilide, 1-phenyl-3-methyl-5-pyrazolane, 1-(2', 4', 6'-trichloro-phenyl)-3benzamido-5pyrazolone, 1-(2', 4', 6', -trichloro-phenyl)-3-anilino-5-pyrazolone and 1-phenyl-3-phenyl-acetamide-5-pyrazolone.

8. The recording material of claim 1, further comprising a color-forming aid comprising a nitrogen-containing compound selected from the group consisting of an inorganic ammonium salt, an organic ammonium salt, an organic amine, an organic amide, a urea, a thiourea, a thiazole, a pyrrole, a pyrimidine, a piperazine, a guanidine, an indole, an imidazoline, a triazole, a morpholine, a piperidine, an amidine, a formamidine and a pyridine.

9. The recording material of claim 8, further comprising a thermo-fusing substance having a melting point in a range of 50° to 150° C. and present in an amount effective to fuse said diazo compound, said coupling compound and said color-forming aid upon heating.

10. The recording material of claim 8, wherein said coupling compound is present in a ratio of 0.1 to 10 parts per one part said diazo compound, and said color-forming aid is present in a ratio of 0.1 to 20 parts per one part said diazo compound.

11. The recording material of claim 1, wherein said diazo compound is present in said recording layer in a dry coated amount of 0.05 to 5.0 g/m$^2$.

12. The recording material of claim 1, wherein said recording layer comprises a first sublayer containing said diazo compound, a second sublayer containing said hydroxyphenylsulfone derivative and a third sublayer containing said coupling compound.

13. The recording material of claim 1, wherein said recording layer comprises a first sublayer containing said diazo compound and said hydroxyphenylsulfone derivative and a second sublayer containing said coupling compound.

* * * * *